United States Patent [19]

Walk et al.

[11] 4,040,363

[45] Aug. 9, 1977

[54] COMBINATION HATCH COVERS

[75] Inventors: Howard J. Walk; Dallas W. Rollins, both of St. Charles, Mo.

[73] Assignee: ACF Industries, Incorporated, New York, N.Y.

[21] Appl. No.: 694,000

[22] Filed: June 8, 1976

Related U.S. Application Data

[63] Continuation of Ser. No. 365,533, May 31, 1973, abandoned.

[51] Int. Cl.[2] ..... B61D 39/00

[52] U.S. Cl. ..... 105/377

[58] Field of Search ..... 105/377; 22/29; 220/27, 220/29; 52/45, 51; 105/377, 261, 310; 280/5; 296/100

[56] References Cited

U.S. PATENT DOCUMENTS

| | | | |
|---|---|---|---|
| 1,226,511 | 5/1917 | Harper | 105/377 |
| 2,067,994 | 1/1937 | Thwaits | 220/32 |
| 2,346,636 | 4/1944 | Porter | 206/12 |
| 2,485,814 | 10/1949 | Cohan | 132/83 |
| 2,999,559 | 9/1961 | Boyer | 105/377 |
| 3,217,661 | 11/1965 | Kemp | 105/377 |
| 3,228,353 | 1/1966 | Carney | 105/377 |
| 3,259,078 | 7/1966 | Radey | 105/377 |
| 3,523,506 | 11/1970 | Williams | 105/377 |
| 3,631,816 | 1/1972 | Miller | 105/377 |
| 3,677,196 | 7/1972 | Schuller | 105/377 |
| 3,796,168 | 3/1974 | Zeller | 105/377 |

*Primary Examiner*—Richard A. Bertsch
*Attorney, Agent, or Firm*—Henry W. Cummings

[57] ABSTRACT

In accordance with the present invention a combination hatch cover design is provided in a railway hopper car roof wherein a smaller hatch cover is entirely mounted upon a larger, preferably elongated or continuous hatch cover and wherein the smaller hatch cover can be operated independently of the locking arrangement of the larger cover. The combination hatch covers of the present invention may be made of metallic or non-metallic material, preferably of metal alloy or reinforced plastic. If desired, the small cover can be mounted with its axis along the longitudinal axis of the large cover whereby in open position the small hatch cover will not obstruct the walkway on the car.

31 Claims, 12 Drawing Figures

COMBINATION HATCH COVERS

REFERENCE TO RELATED APPLICATION

This application is a continuation of application Ser. No. 365,533, filed May 31, 1973, now abandoned.

BACKGROUND OF THE INVENTION

Various designs for hatch covers for railway car have been available for some time. For example U.S. Pat. No. 3,250,233 elongated hatch covers are disclosed in which a strap is mounted on one side of the opening and the strap is affixed to the cover by means of welding and/or bolts and latch means is provided at the opposite side of the opening for holding the strap down and the hatch cover closed during transit. A torsion bar is utilized to aid in raising the hatch cover to the open position.

While most hatch covers have been made of metal, recently the use of non-metallic material, particularly fiber reinforced plastic, or fiberglass for hatch covers has been suggested in U.S. Pat. No. 3,605,639. Longitudinal reinforcements are provided in accordance with this design.

It has also been suggested to provide a smaller hatch cover within a larger elongated hatch cover in U.S. Pat. No. 3,523,506. The large elongated opening may be used for loading ladings wherein dusting is not a problem. If dusting is a problem the smaller hatch opening may be used. Furthermore, in order to utilize the small cover it is necessary to unlatch both the large cover latch and the small cover latch. This operation is somewhat time consuming and can be unpleasant in inclement weather.

SUMMARY OF THE INVENTION

It is an object of the present invention to provide a combination hatch cover design having large openings which may be utilized in loading ladings wherein dusting is not a problem and having small covers which may be utilized in the loading of ladings wherein dusting is a problem.

It is another object of the present invention to provide a combination hatch design wherein the smaller covers are mounted entirely upon the larger covers.

It is another object of the present invention to provide a combination hatch cover design wherein the smaller covers may be operated independently of the hatching mechanism in the larger covers.

Still another object of the present invention is to provide a combination hatch cover design wherein the smaller covers in open position do not obstruct the walkway on the car.

Another object of the present invention is to provide a hatch cover design which can be utilized for metallic or non-metallic covers.

In accordance with the present invention a combination hatch cover design is provided for use in a railway car roof wherein a smaller hatch cover is entirely mounted upon a larger hatch cover and wherein the smaller hatch cover and the larger hatch cover each have their own separately operable latches whereby the larger cover can be opened and closed while the small cover remains in closed position on the large cover, and wherein the small cover can be opened and closed while the large cover remains in closed position. The combination hatch covers of the present invention may be made of metallic or non-metallic material, preferably of metal alloy or reinforced plastic. If desired, the small cover can be mounted with its axis along the longitudinal axis of the large cover whereby in open position the small cover will not obstruct the walkway on the car roof.

THE DRAWINGS

SUMMARY OF THE INVENTION

Figure 1:
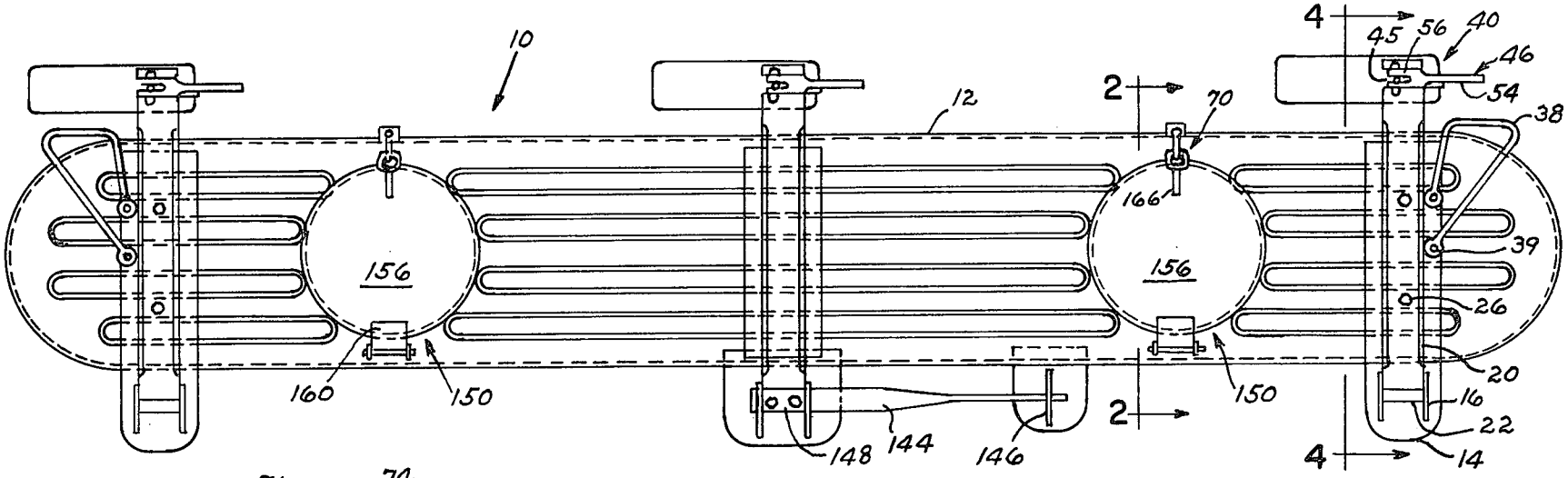
FIG. 1 is a top view of one embodiment of the combination hatch cover design of the present invention.
Figure 2:
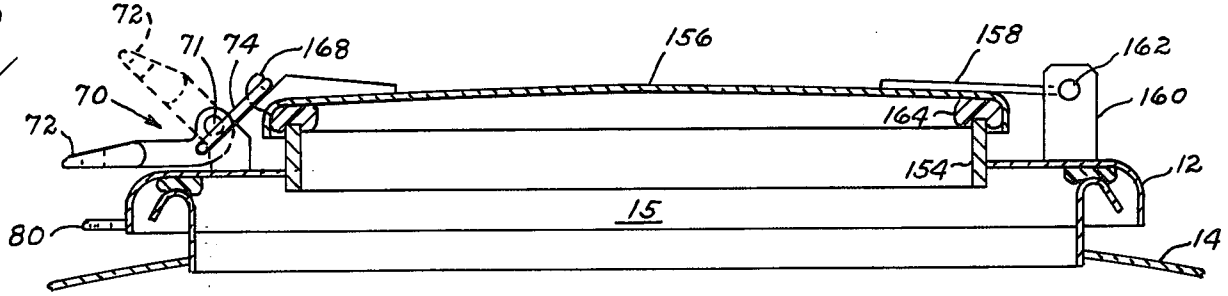
FIG. 2 is a sectional view along the lines 2—2 in FIG. 1.

In accordance with the present invention a combination hatch cover design is provided wherein a smaller hatch cover is entirely mounted upon a larger, preferably elongated or continuous hatch cover and wherein the smaller hatch cover can be operated independently of the locking arrangement of the larger cover. The combination hatch covers of the present invention may be made of metallic or non-metallic, preferably of metal alloy or reinforced plastic. If desired, the small cover can be mounted with its axis along the longitudinal axis of the large cover whereby in open position the small hatch cover will not obstruct the walkway on the car.

DETAILED DESCRIPTION

In accordance with one embodiment of the present invention shown in FIGS. 1 through 4, the combination hatch cover is indicated generally at 10. The combination hatch cover comprises an elongated hatch 12 mounted upon a railroad car 14 and adapted to close an opening therein 15. The combination hatch covers of the present invention may be made of metallic or non-metallic material. Metallic materials include metals and alloys. Particularly preferred metallic materials are the metal alloys steel, and aluminum alloys. Non-metallic materials include suitable inorganic compounds, fiber reinforced inorganic compounds, plastics and reinforced plastics. Particularly preferred non-metallic materials are reinforced plastics, most preferably glass fiber reinforced plastic known as fiber glass. As is disclosed in U.S. Pat. No. 3,307,498, which is hereby incorporated into the present application by reference, a bracket 16 is mounted on the car and strap 20 is pivoted about the bracket by means of a pin 22. The strap is fixed to the cover by appropriate means, for example, by means of bolts 24 and nuts 26. Preferably as shown in the drawings, a plate 28 is welded to ribs 18 on the cover 12 at the upper portions thereof as indicated at 30. In this arrangement plate 28 has openings therein 31 through which bolts 24 pass. A seal 32 is preferably affixed to the cover 12. In the closed position seal 32 engages a rim 34 which is welded to the roof 14 of the car as indicated at 36. A handhold 38 is preferably affixed to the cover or strap by appropriate means such as indicated at 39 nuts and bolts.

Appropriate latching means as indicated generally at 40 are provided on the opposite side of the car for holding the cover in closed position during transit. For example, this may take the form generally illustrated in the said U.S. Pat. No. 3,307,498. The free extending end of strap 20 is bent downwardly at 42 to form a recessed end portion 44. End portion 44 has an outwardly opening slot 45 facing in a direction generally along the longiitudinal axis of railway car 14.

To hold strap 20 and hatch cover 12 in secured position, a cam-type locking lever generally indicated 46 is carried by a swing bolt 48 threaded on its free end. The lower end of swing bolt 48 is pivoted about bolt 50 mounted on jugs 52 secured to roof 14. Locking lever 46 comprises as elongate handle 54. bifurcated adjacent one end to form spaced arms 56 receiving bolt 48. A cam lug 60 projects laterally outwardly from each arm 56 to provide a relatively small surface area contacting strap 20 for locking lever 46 against strap 20 in locked position.

Mounting lever 46 for pivotal movement relative to swing bolt 48 is a pivot pin 62 having an internally threaded bore or opening 64 extending generally at right angles to the longitudinal axis of pin 62 receiving threaded swing bolt 48. Pin 62 fits through suitable openings in arms 56 and lever 46 may be pivoted relative to pin 62. Slot 45 is of a width greater than the outer extent of arms 56 and the length of pivot pin 62 thereby to receive arms 56 and leave only lugs 60 in contact with a relatively small surface area of strap 20.

To adjust locking lever 46 for strap 20 of varying resiliencies and varying tolerances, pivot pin 62 with locking lever 46 are initially threaded on swing bolt 48 until a selected position on swing bolt 48 is determined. Then, pivot pin 62 is spot welded to swing bolt 48. In this manner, sufficient bias from strap 20 is exerted against lever 46 to hold the lever in locked position without the provision of any additional securing means.

Figure 4:
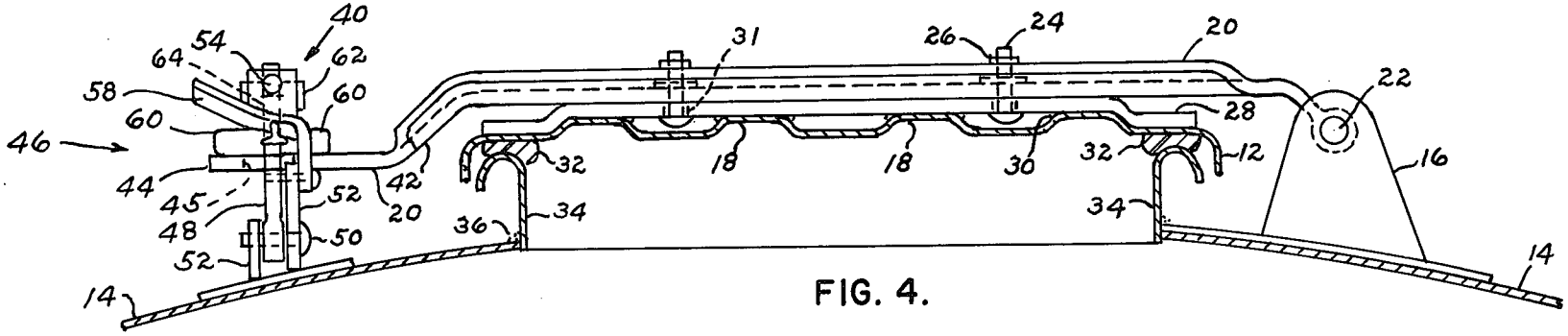
FIG. 4 is a sectional view along the lines 4—4 in FIG. 1.

As shown in FIG. 4, lug 60 projects from each arm 56 and lies in a plane with the axis of pin 62 which is greater than 45° with respect to the longitudinal axis of swing bolt 48 in the open position of lever 46. The bias of strap 20 exerted against cam lugs 60 aids in pivoting lever 46 to an upward position as arms 56 are received within slot 45.

To secure strap 20 from the unlocked position, handle 54 is gripped and lifted to open position with bolt 48 being received in slot 45. Then, lever 46 is pivoted about pivot pin 62. Cam lugs 60 engage strap 20 and pass dead center position with respect to the pivots formed by pivot pin 62 and bolt 50. Thus, the bias of resilient strap 20 adjacent lugs 60 urges lever 46 to a locked position and no additional securing means is required in order to hold lever 46 in locked position.

When lever 46 is moved into the locked position of FIG. 4, lugs 60 contact strap 20 and pass a dead center position with respect to the pivots formed by pivot pin 62 and bolt 48 when moved to the locked position. The bias of strap 20 against lugs 60 continuously urges lever 46 toward a locked position after lever 46 reaches its locked position.

If desired, a locking handle 58 may be affixed to lug 52 as shown in FIG. 4. After handle 54 is put into the locked position, locking handle 58 may be rotated upwardly to maintain handle 54 in locked position during transit.

Figure 3:
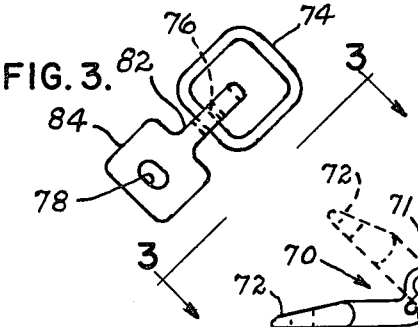
FIG. 3 is a view along the lines 3—3 in FIG. 2.

Other latching arrangements may also be used. For example, the latching arrangement illustrated in Carney et al U.S. Pat. No. 3,250,233 (hereby incorporated into the present application by reference) may be used. As shown in FIG. 3 of the said U.S. Pat. No. 3,250,233, the free end of each strap 40 has an open slot 47. Pivotally mounted at 48 is a swing bolt 50 adapted to fit within slot 47 and having a yoke fitting over projection 49 on roof 14. A handwheel 52 threadedly engages bolt 50 and when screwed down tight against arm 40 holds the cover in a tight closed position.

Strap 40 may move downwardly on stub 54 relative to nut 56 and upon tightening of handwheel 52 when hatch cover 34 is in closed position arm 40 will be pulled downwardly out of contact with nut 56. Upon loosening of handwheel 52 and swinging of bolt 50 away from strap 40, nut 56 is again engaged by the strap.

Other latching arrangements may be apparent to those skilled in the art.

Referring again to the drawings of the present application, if desired, as described in the said U.S. Pat. No. 3,250,233, a torsion bar 144 may be provided rigidly mounted to the car at 146 and affixed to the cover and strap arrangement at 148. Other resilient devices may also be provided to aid in raising and lowering the large cover.

A small hatch cover arrangement indicated generally at 150 is mounted upon large cover 12 by appropriate means. For example, a bracket 160 may be affixed to the large cover, for example, by welding having a pin 162 extending therethrough. A butt hatch strap 158 may be pivotally mounted about the pin 162 and appropriately affixed, for example, by welding to the small cover 156. The cover 156 preferably has mounted thereon, for example with an appropriate adhesive, a seal 164. Seal 164 engages a rim 154 which is appropriately affixed to cover 12, for example, by welding. A locking member 166 is provided on small cover 156, by appropriate means, such as welding, having a locking hook 168 thereon.

An overcenter locking lever means indicated generally at 70 is mounted upon the large cover, for example, by welding. The overcenter locking means comprises a pin 71 upon which is pivotally mounted a handle 72. The handle 72 preferably comprises a portion of small cross section 82 and large cross section 84 as indicated in FIG. 3. A locking ring 74 is provided within an opening 76 in handle 72 so that the ring will not be lost or misplaced by the operator.

In operation, the cover 156 is moved to the closed position with seal 164 engaging rim 154. Handle 72 is raised to the position shown dotted in FIG. 2 so that locking ring 74 engages hook 168. Then the handle 72 is moved to the position shown in solid lines in FIG. 2 with the locking lever in the overcenter position to hold the small cover in place.

If desired, a railroad seal may be provided in openings 78 and in seal bar 80 which is appropriately affixed to the large cover, for example, by welding.

It will be apparent that the small covers 156 can be opened and closed independently of the locking arrangement for the large cover 12. Thus, for ladings where dusting is a problem, the small covers may be quickly and efficiently utilized to load the car and the dusting problem avoided. With ladings where dusting is not a problem, the large cover may be utilized by means of handle 38 and the small cover will simply remain in the closed position during opening and closing of the large covers. Such flexibility and ease of operation is achieved by the combination cover design of the present invention.

Figure 5:
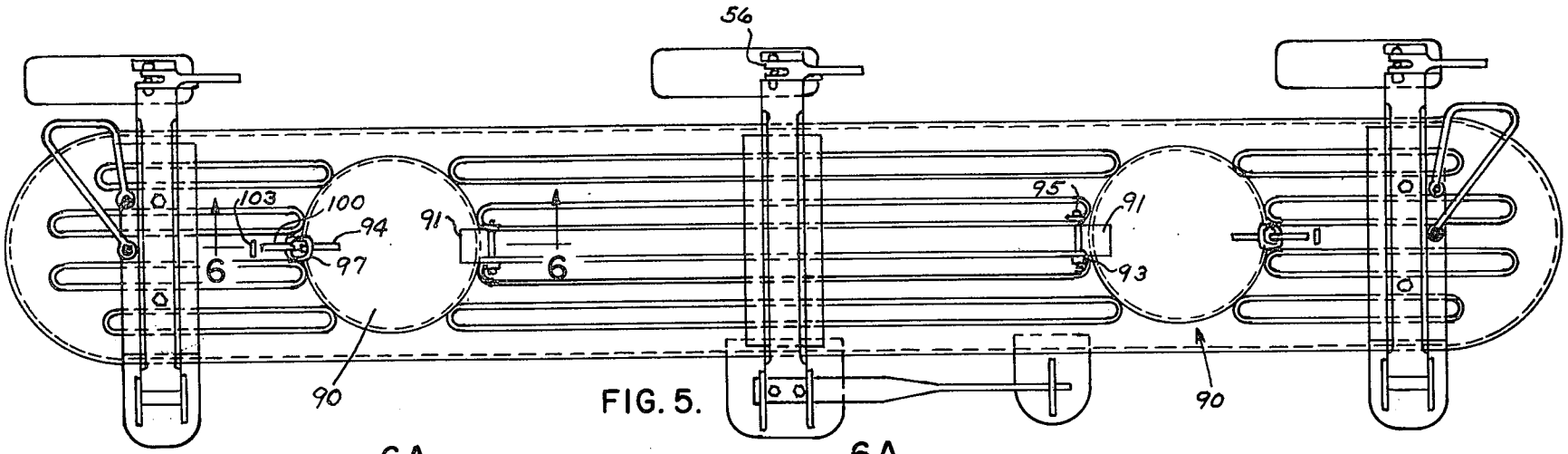
FIG. 5 is a top view of another embodiment of the combination hatch cover of the present invention.
Figure 6:
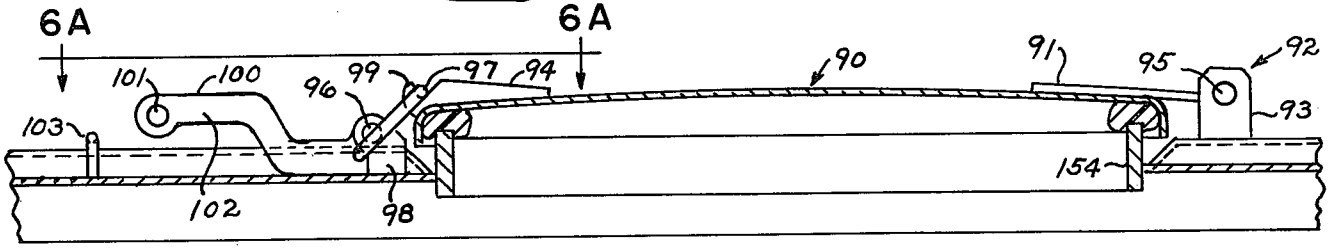
FIG. 6 is a view along the lines 6—6 in FIG. 5.
Figure 6A:
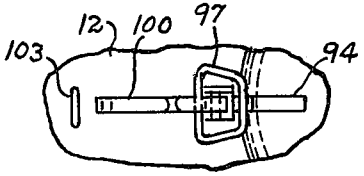
FIG. 6A is a view along the lines 6A—6A in FIG. 6.

In another embodiment of the present invention shown in FIGS. 5 and 6 the small covers indicated at 90 are mounted at 90° with respect to the embodiment shown in FIGS. 1 through 4. The mounting arrangement for the small covers indicated generally at 92 includes brackets 93 and pin 95. The butt strap 91 operates similar to the embodiment shown in FIGS. 1 through 4. Cover 90 has appropriately mounted thereon a locking lug 94 having a hook thereon 99. A locking ring 97 is also provided mounted within an overcenter locking lever 100 pivoted about a pin 96, which is mounted upon cover 12 by means of bracket 98. Handle 102 of locking lever 100 is raised to allow ring 97 to engage hook 99 and then is lowered to the closed overcenter position shown in FIG. 6. If desired, a railroad seal may be provided in opening 101 engaging member 103 mounted upon the large cover.

The advantage of this design over the design shown in FIGS. 1 through 4 is that in the open position the small cover does not extend over the walkway and thereby create a safety hazard for the operator working on the car roof during loading and unloading the car.

In another embodiment of the present invention, particularly adapted for the use of fiberglass or plastic covers, is shown in FIGS. 7–10. It will be apparent that in this embodiment the small covers are mounted transversely with respect to the longitudinal axis of the large cover. The large cover indicated generally at 112 comprises an outer member 114 and an inner member 116. Members 114 and 116 are joined together longitudinally at an outer portion 118, for example, with an adhesive and again longitudinally at another area indicated generally at 120. Appropriate means indicated generally at 122. for example, comprising collars 124 and huck bolts 126 are provided for mounting a hinge bracket 128 thereon. Large cover inner member 116 extends inwardly and then is provided with an upwardly extending rim 130. Hinge bracket 128 by means of pin 132 has a butt hinge strap 134 mounted thereon. Appropriate means such as huck bolts 136 are provided to engage butt hinge strap 134 with small cover member 240. Rim 130 comprises an outer rim portion 131 and an inner rim portion 133 joined together by an upper rim portion 135. Cover 240 comprises a lower depending outer ring 244. Affixed to small cover 240 by means such as appropriate adhesive, is a seal member 246. Seal member 246 engages upper rim portion 135.

Cover 240 at the opposite end thereof is provided with locking member 248 affixed to the cover by appropriate means, for example, by means of huck bolts 250. The locking member 248 has at one end thereof a hook portion 252.

Mounted upon the large cover 112 is an overcenter locking lever indicated generally at 260. For example, huck bolts 262 may be provided to hold in place plate 261 upon which is mounted a bracket 271. Bracket 271 has a pin therein 266 holding in place a locking handle 268. Handle 268 preferably includes a portion of amall cross section 270 and a portion of large cross section 272. A locking ring 274 extends through locking lever 268.

In operation, the small cover 240 is lowered into closed position with seal 246 engaging the upper portion of rim 130. Handle 268 is raised to enable ring 274 to engage hook 252 of locking member 248. Then, locking lever 268 is moved to the position shown in FIG. 8 to hold the cover in the closed position. The cover, of course, can be opened by again raising locking lever 268.

A seal may be provided in the closed position by inserting a railway seal through an opening 276 in handle 268 and opening 263 in plate 261.

Figure 7:
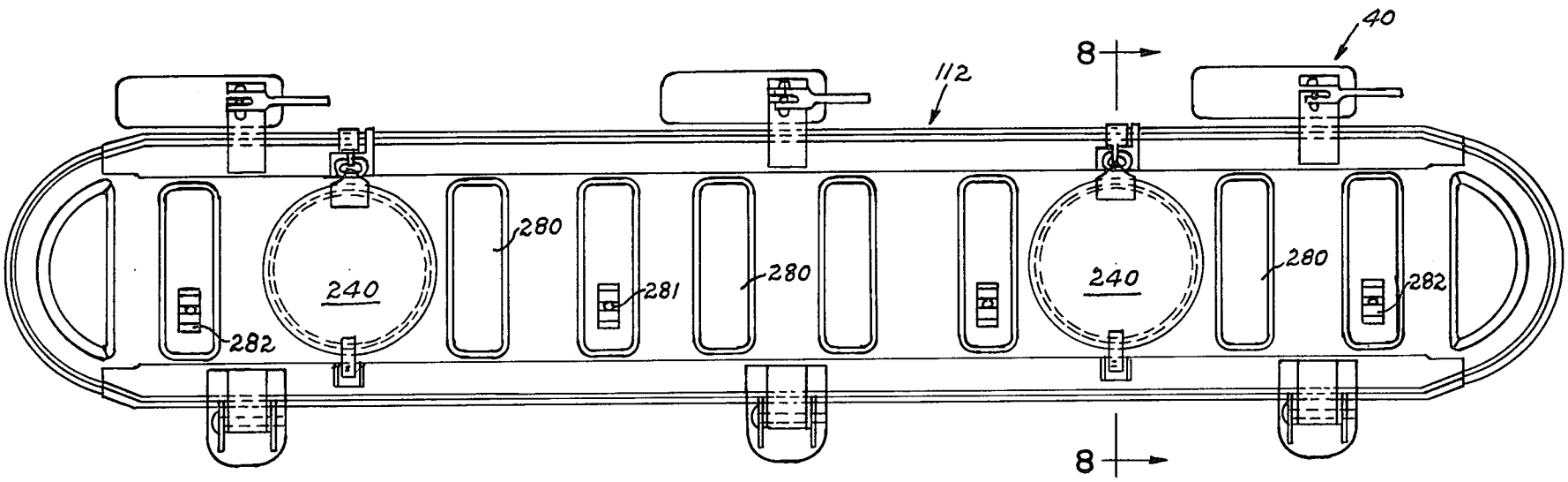
FIG. 7 is a top view of another embodiment of the present invention.
Figures 8, 9, 10, 11:
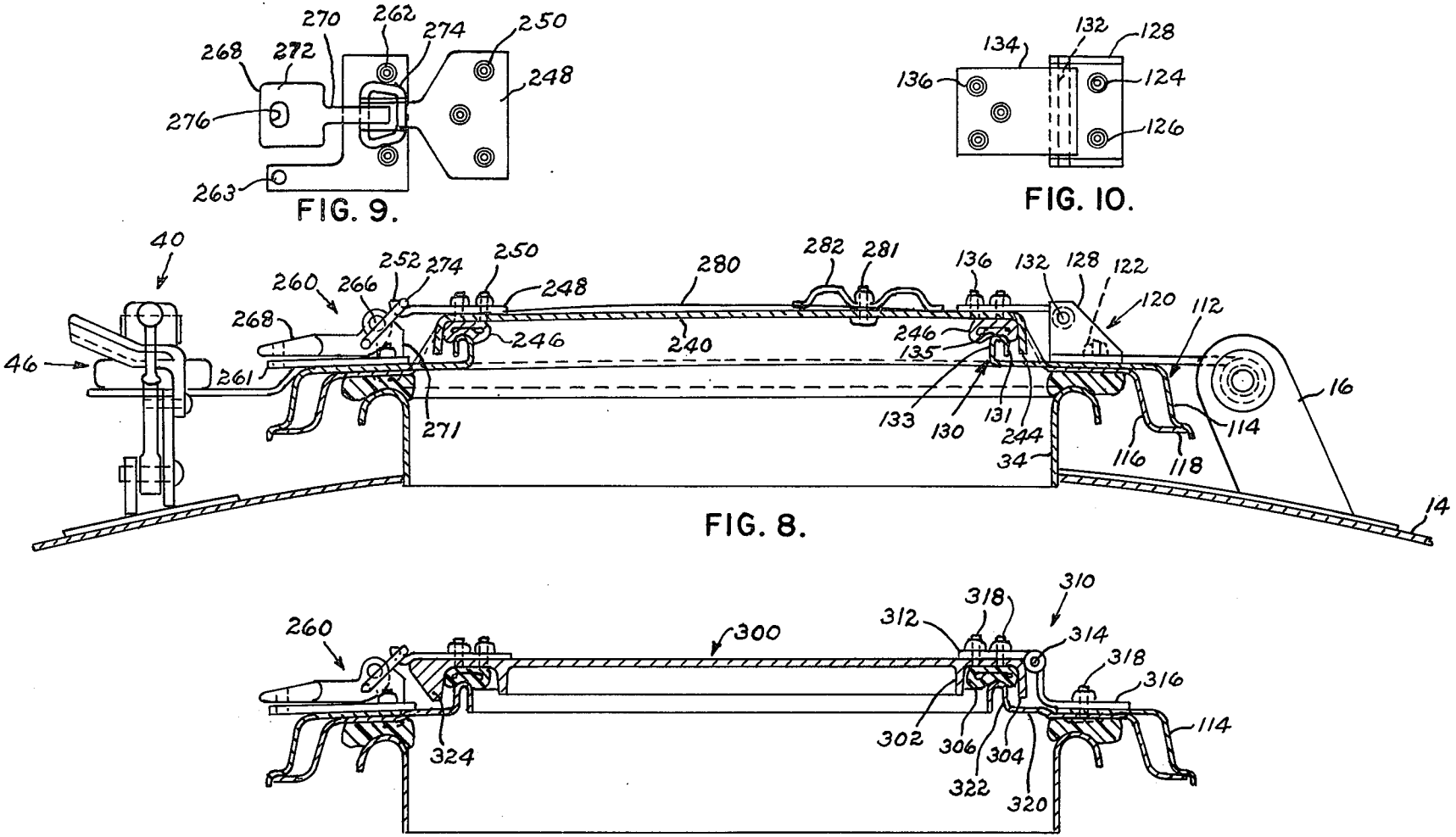
FIG. 8 is a sectional view along the lines 8—8 in FIG. 7.
FIG. 9 is a top view of the locking device shown in FIG. 8.
FIG. 10 is a top view of the hinge shown in FIG. 8.
FIG. 11 is a sectional view of still another embodiment of the combination hatch cover of the present invention.

Large fiberglass or plastic cover 112 may comprise reinforcing ribs 280 as shown in FIGS. 7 and 8. Affixed to ribs 280 at appropriate places by an adhesive and huck bolts 281 are raised striking sections 282. These striking sections 282 mounted on large cover 112 prevent small covers 240 from being damaged when large cover 112 is opened against the walkway.

Another embodiment of the present invention, particularly adapted for the use of fiberglass or plastic covers, is shown in FIG. 11. Small fiberglass or plastic cover 300 comprises a lower depending inner ring 302 and a lower depending outer ring 304. Affixed to small cover 300 by means such as an appropriate adhesive is a seal member 306.

A hinge bracket 310 comprises a butt hinge strap 312 with a pin 314 and a connecting butt strap 316. Hinge bracket 310 is affixed to small cover 300 and large cover 114 by appropriate means such as huck bolts 318.

Large cover inner member 320 in FIG. 11 extends inwardly and then is provided with an upwardly extending rim 322. It is to be noted that rim 322 is reversed as to rim 130 shown in FIG. 8. Small cover 300 has an enlarged cross section 324 at the overcenter locking side area. The operation of the lever 260 for small cover 300 is the same as noted for FIG. 8.

What is claimed is:

1. A combination hatch cover for railway car roofs comprising:

an elongated hatch cover made from a material selected from the group consisting of metallic and non-metallic material, having its longitudinal axis adapted to extend along the longitudinal axis of the railway car and adapted to close a longitudinally extending opening in the car roof;

at least one strap pivotally mounting said elongated cover for transverse movement between open and closed positions with respect to the opening in the roof;

said strap adapted to engage elongated cover latch means mounted upon said car for holding said elongated cover in closed position;

at least one opening provided in said elongated cover;

means pivotally mounting a small hatch cover on said elongated cover;

said small cover adapted to move between open and closed positions with respect to said opening in said elongated cover;

said small cover having a locking portion affixed thereto;

small cover latch means mounted upon said elongated cover comprising an overcenter locking lever including a locking handle and a locking ring and wherein said locking ring engages said locking portion adapted to hold said smaller cover in closed position;

said small cover latch means being operable independently of said elongated cover latch means whereby said small cover may be opened and closed while said elongated cover is in closed position and whereby said elongated cover may be moved between open and closed positions with said small cover remaining closed during such movement.

2. A combination hatch cover according to claim 1 wherein the longitudinal axis of said smaller cover is generally transverse with respect to the longitudinal axis of said elongated cover.

3. A combination hatch cover according to claim 1 wherein the longitudinal axis of said smaller cover is in the same general direction as the longitudinal axis of said elongated cover.

4. A combination hatch cover according to claim 1 wherein said small cover locking portion comprises a hook which engages said locking ring.

5. A combination hatch cover according to claim 1 wherein said elongated cover is a continuous hatch cover.

6. A combination hatch cover for railway car roofs comprising:

an elongated hatch cover made from a material selected from the group consisting of metallic and non-metallic material, having its longitudinal axis adapted to extend along the longitudinal axis of the railway car and adapted to close a longitudinally extending opening in the car roof;

at least one strap pivotally mounting said elongated cover for transverse movement between open and closed position with respect to the opening in the roof;

said strap adapted to engage elongated cover latch means mounted upon said car for holding said elongated cover in closed position; at least one opening provided in said elongated cover;

means pivotally mounting a small hatch cover generally transverse to the longitudinal axis of said elongated cover, said small cover adapted to move between open and closed positions generally transverse with respect to the longitudinal axis of said elongated cover;

said small cover having a locking portion affixed thereto;

small cover latch means mounted upon said elongated cover comprising an overcenter locking lever including a locking handle and a locking ring and wherein said locking ring engages said locking portion to hold said smaller cover in closed position;

said small cover latch means being operable independently of said elongated cover latch means whereby said small cover may be opened and closed while said elongated cover is in closed position and whereby said elongated cover may be moved between open and closed positions with said small cover remaining closed during such movement.

7. A combination hatch cover according to claim 6 wherein said hatch cover is made of non-metallic material.

8. A combination hatch cover according to claim 6 including elongated cover latch means mounted on the car comprising a cam locking lever which engages said strap.

9. A combination hatch cover according to claim 8 wherein said cam locking lever is affixed to a swing bolt which is mounted on the car.

10. A combination hatch cover according to claim 8 wherein a swing bolt is mounted on the car which engages said strap and a handwheel in locked position.

11. A combination hatch cover according to claim 6 wherein said elongated cover is a continuous hatch cover.

12. A combination hatch cover for railway car roofs comprising:

an elongated hatch cover made from a material selected from the group consisting of metallic and non-metallic material, having its longitudinal axis adapted to extend along the longitudinal axis of the railway car and adapted to close a longitudinally extending opening in the car roof;

at least one strap pivotally mounting said elongated cover for transverse movement between open and closed positions with respect to the opening in the roof;

said strap adapted to engage elongated cover latch means mounted upon said car for holding said elongated cover in closed position;

at least one opening provided in said elongated cover;

means pivotally mounting a small hatch cover generally along the longitudinal axis of said elongated cover, said small cover adapted to move between open and closed positions generally along the longitudinal axis of said elongated cover;

said small cover having a locking portion affixed thereto;

small cover latch means mounted upon said elongated cover comprising an overcenter locking lever including a locking handle and a locking ring and wherein said locking ring engages said locking portion to hold said smaller cover in closed position;

said small cover latch means being operable independently of said elongated cover latch means whereby said small cover may be opened and closed while said elongated cover is in closed position and whereby said elongated cover may be moved between open and closed positions with said small cover remaining closed during said movement.

13. A combination hatch cover according to claim 12 wherein said hatch cover is made of metallic material.

14. A railway car roof for use in railway freight cars to be loaded and unloaded in upright position comprising: a roof rigidly attached to opposite sides of the car; said roof having at least one elongated hatch opening extending longitudinally of the car; a combination hatch cover made from a material selected from metallic and non-metallic materials mounted upon said roof including an elongated hatch cover having a longitudinal axis extending along the longitudinal axis of the car and adapted to close said elongated hatch opening; said elongated cover having means mounted on said roof on a first side of said elongated hatch opening pivotally mounting said elongated cover for generally transverse movement between open and closed positions with respect to said elongated hatch openings; said elongated cover adapted to engage elongated cover latch means mounted upon said roof on a second side of said elongated hatch opening for holding said elongated cover in closed position; at least one small cover opening provided in said elongated cover; means located on said elongated cover adjacent said small cover opening pivotally mounting a small hatch cover on said elongated cover; said small hatch cover being moveable between open and closed positions with respect to said small cover opening; small cover latch means mounted upon said elongated cover adapted to hold said small cover in closed position closing said small cover opening; said small cover latch means being operable independently of said elongated cover latch means whereby said small cover may be closed while said elongated cover is in closed position; and said elongated cover latch means being operable independently of said small cover latch means, whereby said elongated cover may be moved between open and closed positions when said car is in upright position with said small cover remaining closed during such elongated cover movement.

15. A railway car roof according to claim 14 wherein said non-metallic material is selected from inorganic compounds, fiber reinforced inorganic compounds, plastics and reinforced plastic.

16. A railway car roof according to claim 14 wherein resilient means are provided to assist the operator in raising said elongated cover.

17. A railway car roof according to claim 16 wherein the resilient means comprises a torsion spring.

18. A railway car roof according to claim 16 wherein said elongated cover is a continuous hatch cover.

19. In a covered hopper railway car having trucks located at opposite ends of the car supporting a hopper car body including a pair of transversely spaced side sills and a pair of transversely spaced top chords; side sheets joining said side sills and top chords on each side of the car; at least one hopper extending longitudinally of the car defined at least in part by said side sheets; said hopper having an outlet at the lower portion thereof for unloading lading from the car while the car remains in upright position supported by said truck on a railway car track; a railway car roof rigidly attached to said top chords extending longitudinally of the car; said roof having an elongated hatch opening having a longitudinal axis extending longitudinally of the car for loading the car with lading; the improvement comprising;

a combination hatch cover made of a material selected from metallic and non-metallic materials including at least one elongated cover having a longitudinal axis extending along the longitudinal axis of the car and adapted to close said elongated hatch opening; said elongated hatch cover having means mounted on said roof on a first side of said elongated hatch opening pivotally mounting the elongated cover for generally transverse movement between open and closed positions with respect to said elongated hatch opening; said elongated cover adapted to engage elongated cover latch means mounted upon said roof on a second side of said elongated hatch opening for holding said elongated cover in closed position; at least one small cover opening provided in said elongated cover; means located on said elongated cover adjacent said small cover opening pivotally mounting a small hatch cover for movement between open and closed positions with respect to said small cover opening; small cover latch means located upon said elongated cover adjacent said small cover opening adapted to hold said small cover in closed position closing said small cover opening; said small cover latch means being operable independently of said elongated cover latch means whereby said small cover may be opened and closed while said elongated cover is in closed position; and said elongated cover latch means being operable independently of said small cover latch means whereby said elongated cover may be moved between open and closed positions when said car is in upright position with said small cover remaining closed during such elongated cover movement.

20. A railway car according to claim 19 wherein said combination hatch cover is made of metallic material.

21. A railway car according to claim 20 wherein said metallic material is selected from steel and aluminum alloys.

22. A railway car according to claim 19 wherein said combination cover is made of non-metallic material.

23. A railway car according to claim 22 wherein said non-metallic material is selected from inorganic compounds, fiber reinforced inorganic compounds, plastics and reinforced plastics.

24. A railway car according to claim 23 wherein the combination hatch cover is made from reinforced plastic material.

25. A railway car according to claim 24 wherein the reinforced plastic material is fiberglass.

26. A railway car according to claim 19 wherein said small cover is movable between open and closed positions transversely with respect to the longitudinal axis of said hatch opening.

27. A railway car according to claim 19 wherein a seal is affixed to the outer portion of said small cover which peripherally engages a portion of said elongated cover in closed position.

28. A railway car according to claim 19 wherein projections are provided on said elongated cover to protect said small cover.

29. A combination hatch cover for use on railway cars having a longitudinally extending opening in the car roof and running boards on the roof extending longitudinally along opposite sides of said opening; said cars to be loaded and unloaded in upright position comprising:

an elongated hatch cover having its longitudinal axis adapted to extend along the longitudinal axis of the railway car and adapted to close said longitudinally extending opening in the car roof; said elongated cover being pivotally mounted for generally transverse movement between open and closed positions with respect to the opening in the railway car roof; said elongated cover adapted to engage elongated cover latch means mounted upon said roof for holding said elongated cover in closed position; at least one small cover opening provided in said elongated cover; a small hatch cover pivotally mounted on said elongated cover for generally parallel movement with respect to the longitudinal axis of the elongated cover and the longitudinal axis of the rail car; small cover latch means located upon said elongated cover adapted to hold said small cover in closed position; said small cover latch means being operable independently of said elongated cover latch means whereby said small cover may be opened and closed while said elongated cover is in closed position and whereby in open position said small cover is adapted to rest upon said elongated cover, leaving said running boards unobstructed by said small cover, and said elongated cover latch means being operable independently of said small cover latch means whereby said elongated cover may be moved between open and closed positions when the car is in upright position with said small cover remaining closed during such elongated cover movement.

30. A combination hatch cover according to claim 29 wherein said hatch cover is made of metallic material.

31. A combination hatch cover according to claim 29 wherein said metallic material is selected from steel and aluminum alloys.

* * * * *

UNITED STATES PATENT AND TRADEMARK OFFICE

CERTIFICATE OF CORRECTION

PATENT NO. : 4,040,363

DATED : August 9, 1977

INVENTOR(S) : Howard J. Walk and Dallas W. Rollins

It is certified that error appears in the above-identified patent and that said Letters Patent are hereby corrected as shown below:

Column 2, lines 28 - 41, should be deleted.

Column 3, line 19, "jugs" should read -- lugs --.

Column 5, line 65, "amall" should read -- small --.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*